US011820616B2

(12) United States Patent
Macini et al.

(10) Patent No.: US 11,820,616 B2
(45) Date of Patent: Nov. 21, 2023

(54) MAGAZINE UNIT FOR A PACKAGING MACHINE, PACKAGING MACHINE HAVING A MAGAZINE UNIT AND METHOD FOR OPERATING A PACKAGING MACHINE

(71) Applicant: TETRA LAVAL HOLDINGS & FINANCE S.A., Pully (CH)

(72) Inventors: Nicola Macini, Modena (IT); Stefano Palladino, Soliera (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 753 days.

(21) Appl. No.: 16/954,420

(22) PCT Filed: Jan. 18, 2019

(86) PCT No.: PCT/EP2019/051212
§ 371 (c)(1),
(2) Date: Jun. 16, 2020

(87) PCT Pub. No.: WO2019/145223
PCT Pub. Date: Aug. 1, 2019

(65) Prior Publication Data

US 2021/0078818 A1 Mar. 18, 2021

(30) Foreign Application Priority Data

Jan. 29, 2018 (EP) ..... 18153850

(51) Int. Cl.
*B65H 23/08* (2006.01)
*B65B 11/10* (2006.01)
*B65B 11/12* (2006.01)

(52) U.S. Cl.
CPC ..... *B65H 23/08* (2013.01); *B65B 11/105* (2013.01); *B65B 11/12* (2013.01); *B65H 2301/41734* (2013.01)

(58) Field of Classification Search
CPC ..... B65H 23/08; B65H 2301/41734; B65B 11/12; B65B 11/105
See application file for complete search history.

(56) References Cited

U.S. PATENT DOCUMENTS 3,989,201 A * 11/1976 Cottrell ..... B65H 23/18 242/420.2
7,950,602 B2 * 5/2011 Petri ..... B65H 16/06 242/559
2009/0065626 A1 3/2009 Petri

FOREIGN PATENT DOCUMENTS

GB 2018727 A 10/1979
JP 2000-109025 A 4/2000
JP 2013-047122 A 3/2013

* cited by examiner

*Primary Examiner* — Sang K Kim
(74) *Attorney, Agent, or Firm* — BUCHANAN INGERSOLL & ROONEY PC

(57) ABSTRACT

A magazine unit for a packaging machine comprises a support device configured to rotatably carry a reel of a packaging material web and a reel brake device configured to decelerate rotation of the reel around a central axis. The reel brake device comprises a brake assembly adapted to interact with an outer lateral surface of the reel of the packaging material web and configured to selectively exert a deceleration force on the reel of the packaging material web for decelerating the rotation of the reel around the central axis. The reel brake device comprises a support rail moveably carrying the brake assembly and an actuator device configured to actuate, in use, movement of the brake assembly along the support rail at least towards the outer lateral surface so as to establish contact of at least an interaction element of the brake assembly with the outer lateral surface of the reel.

11 Claims, 6 Drawing Sheets

MAGAZINE UNIT FOR A PACKAGING MACHINE, PACKAGING MACHINE HAVING A MAGAZINE UNIT AND METHOD FOR OPERATING A PACKAGING MACHINE

TECHNICAL FIELD

The present invention relates to a magazine unit for a packaging machine, in particular a packaging machine for producing sealed packages of a pourable product, even more particular of a pourable food product. In particular, the present invention is related to a magazine unit comprising a reel brake device configured to decelerate a rotating reel of a web of packaging material.

The present invention also relates to a packaging machine, in particular a packaging machine for producing sealed packages of a pourable product, even more particular of a pourable food product, having a magazine unit comprising a real brake device.

The present invention also relates to a method for operating a packaging machine, in particular a packaging machine for producing sealed packages of a pourable product, even more particular of a pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material from a magazine unit through a sterilization unit for sterilizing the web of packaging material, e.g. by means of chemical sterilization (e.g. by applying a chemical sterilizing agent, such as a hydrogen peroxide solution) or physical sterilization (e.g. by means of an electron beam) and to an isolation chamber (a closed and sterile environment) in which the sterilized web of packaging material is maintained and advanced. During advancement of the web of packaging material through the isolation chamber, the web of packaging material is folded and sealed longitudinally to form a tube having a longitudinal seam portion, which is further fed along a vertical advancing direction.

In order to complete the forming operations, the tube is filled with a sterilized or sterile-processed pourable food product, and is transversely sealed and subsequently cut along equally spaced transversal cross sections within a packaging unit of the packaging machine during advancement along the vertical advancing direction.

Pillow packages are so obtained within the packaging machine, each pillow package having a longitudinal sealing band, a top transversal sealing band and a bottom transversal sealing band.

In more detail, a typical packaging machine comprises:

- a magazine unit adapted to host at a host station at least one reel of a web of packaging material;
- conveying means for advancing the web of packaging material along a web advancement path from the host station to a forming station, at which, in use, the web of packaging material is formed into a tube;
- a sterilizing unit for sterilizing the web of packaging material;
- a tube forming device arranged within an isolation chamber and being adapted to form the tube from the advancing web of packaging material;
- a sealing device for longitudinally sealing the tube;
- a filling device for filling the tube with the pourable product; and
- a package forming unit adapted to produce the single packages from the tube by shaping, transversely sealing and transversely cutting the packages.

A typical magazine unit comprises at least one support device adapted to rotatably carry the reel of web of packaging material so that the reel is rotatable around a central axis for allowing for the unwinding of the web of packaging material.

The magazine unit also comprises a reel brake device configured to decelerate, in use, the rotation of the reel around the central axis, e.g. in the case of a programmed or emergency stop of the packaging machine.

A typical reel brake device comprises:

- a support arm pivoted at a first end portion on a horizontal support plate of the magazine unit and being pivotal around a pivot axis parallel to the central axis of the reel with the reel being carried by the support device; and
- a brake assembly being coupled to the support arm at a second end portion of the support arm opposite to the first end portion.

The brake assembly comprises a brake wheel being adapted to contact an outer lateral surface of the reel of the web of packaging material and being adapted to rotate around a rotation axis parallel to the central axis of the reel upon contact with the outer lateral surface of the reel of web of packaging material and rotation of the reel around the central axis.

The reel brake device also comprises a biasing device coupled to the support arm and being configured to continuously actuate an angular movement of the support arm around the pivot axis so as to continuously bias the wheel brake against the outer lateral surface of the reel. In this way, as in use the diameter of the reel decreases, a continuous contact between the wheel brake and the outer lateral surface of the reel is guaranteed. However, a drawback resides in that the constantly applied pressure of the brake wheel may cause an incorrect unwinding of the web of packaging material.

DISCLOSURE OF INVENTION

It is therefore an object of the present invention to provide a magazine unit for a packaging machine to overcome, in a straightforward and low-cost manner, at least one of the aforementioned drawbacks.

In particular, it is an object of the present invention to provide a magazine unit for a packaging machine having a reel brake device allowing to reduce the risk of an incorrect unwinding of the web of packaging material.

It is a further object of the present invention to provide a packaging machine having a magazine unit to overcome, in a straightforward and low-cost manner, at least one of the aforementioned drawbacks.

It is a further object of the present invention to provide a method for operating a packaging machine to overcome, in a straightforward and low-cost manner, at least one of the aforementioned drawbacks.

According to the present invention, there is provided a magazine unit as claimed in claim 1.

According to the present invention, there is also provided a packaging machine according to claim 7.

According to the present invention, there is also provided a method for operating a packaging machine according to claim 8.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
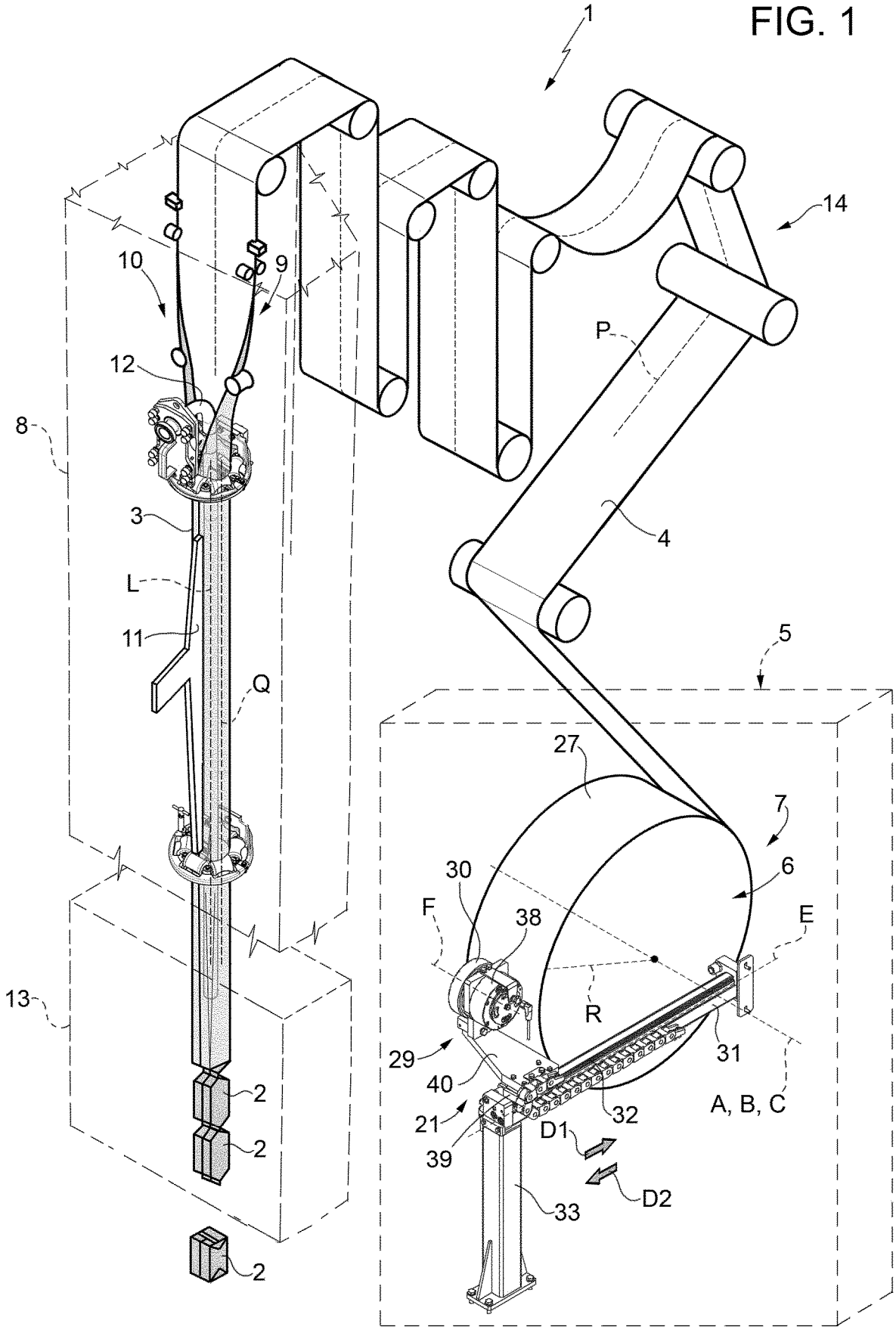
FIG. 1 is a schematic view of a packaging machine for packaging a pourable product, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a web 4 of packaging material. In particular, in use, tube 3 extends along a longitudinal axis L, in particular, axis L having a vertical orientation.

Web 4 of packaging material has a multilayer structure (not shown). Web 4 comprises a respective layer of fibrous material, normally paper, covered on both sides with respective layers of heat-seal plastic material, e.g. polyethylene.

Preferably, web 4 also comprises a respective layer of gas- and light-barrier material, e.g. aluminum foil or ethylene vinyl alcohol (EVOH) film, and at least a respective first layer and a respective second layer of heat-seal plastic material. The respective layer of gas- and light-barrier material is superimposed on the respective first layer of heat-seal plastic material, and is in turn covered with the second layer of heat-seal plastic material. The second layer of heat-seal plastic material forms the inner face of package 2 eventually contacting the filled food product.

A typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 comprises:

- a magazine unit 5 adapted to host at least one reel 6 of web of packaging material 4 at a host station 7;
- an isolation chamber 8 separating an inner environment, in particular an inner sterile environment, from an outer environment;
- a tube forming device 9 extending along a longitudinal axis, in particular having a vertical orientation, and being arranged, in particular at a forming station 10, at least partially, preferably fully, within chamber 8 and being adapted to form tube 3 from the, in use, advancing web 4;
- a sealing device 11 at least partially arranged within chamber 8 and being adapted to longitudinally seal tube 3 formed by tube forming device 9 so as to form a longitudinal seam portion of tube 3;
- filling means 12 for filling tube 3 with the pourable product;
- a package forming unit 13 adapted to at least form and transversely seal tube 3, in particular the, in use, advancing tube 3, for forming packages 2; and
- conveying means 14 for advancing in a known manner web 4 along a respective web advancement path P from host station 7 to forming station 10, at which, in use, web 4 is formed into tube 3 and to advance tube 3 along a tube advancement path Q towards and through package forming unit 13.

In particular, isolation chamber 8 is arranged downstream of magazine unit 5 along path P.

In particular, package forming unit 13 is arranged downstream of isolation chamber 8 and tube forming device 9 along path Q.

Preferably, packaging machine 1 also comprises a sterilizing unit (not shown and known as such) adapted to sterilize the, in use, advancing web 4 at a sterilization station, in particular the sterilization station being arranged upstream of forming station 10 along path P.

Preferentially, conveying means 14 are adapted to advance tube 3 and any intermediate of tube 3 in a manner known as such along path Q, in particular from forming station 10 towards and at least partially through package forming unit 13. In particular, under intermediates of tube 3 any configuration of web 4 is meant prior to obtaining the tube structure and after folding of web 4 by tube forming device 9 has started. In other words, the intermediates of tube 3 are a result of the gradual folding of web 4 so as to obtain tube 3, in particular by overlapping the lateral respective edges of web 4 with one another.

Figure 2:
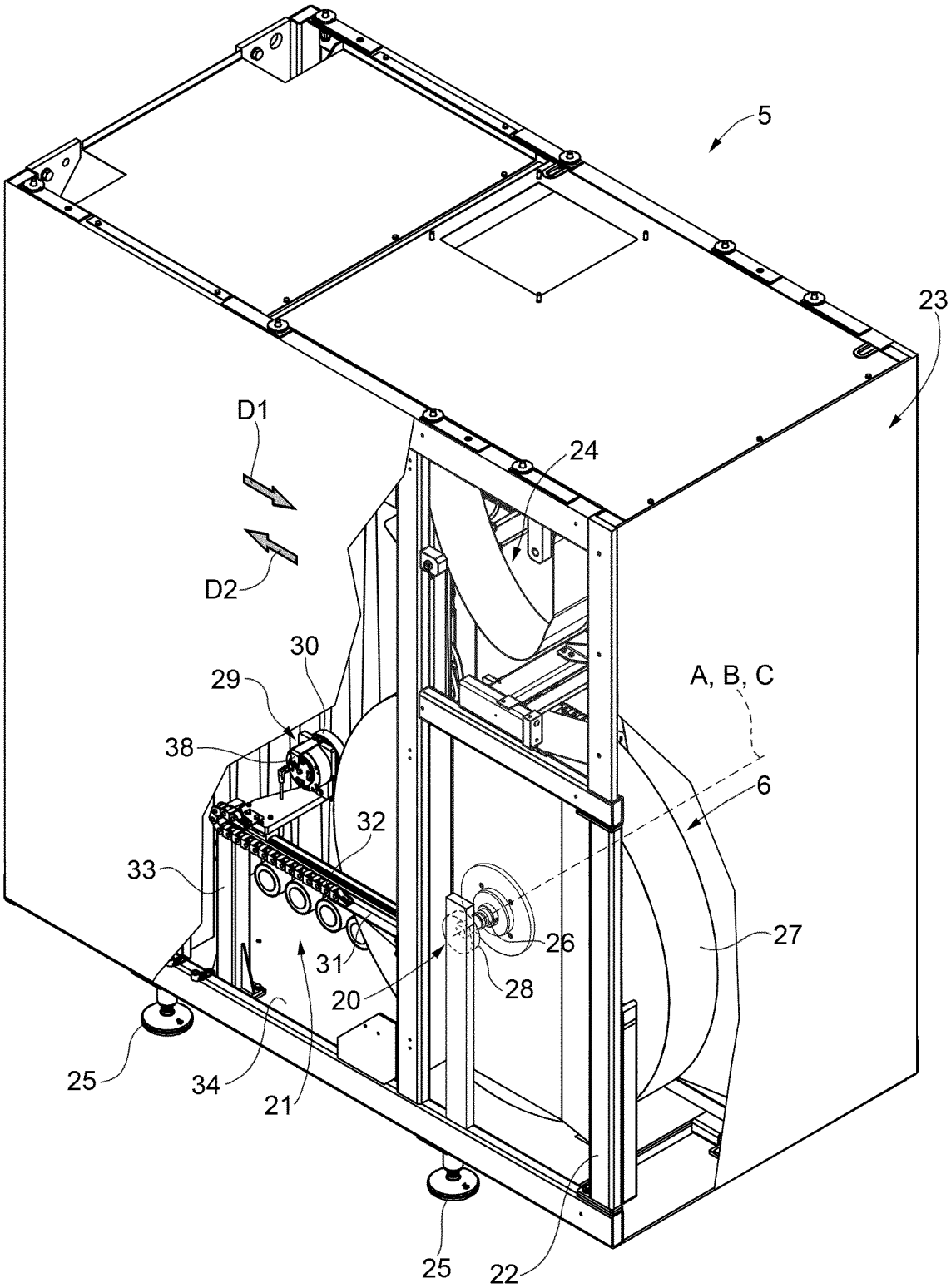
FIG. 2 is a perspective view of a detail of the packaging machine of FIG. 1, with parts removed for clarity.
Figure 3:
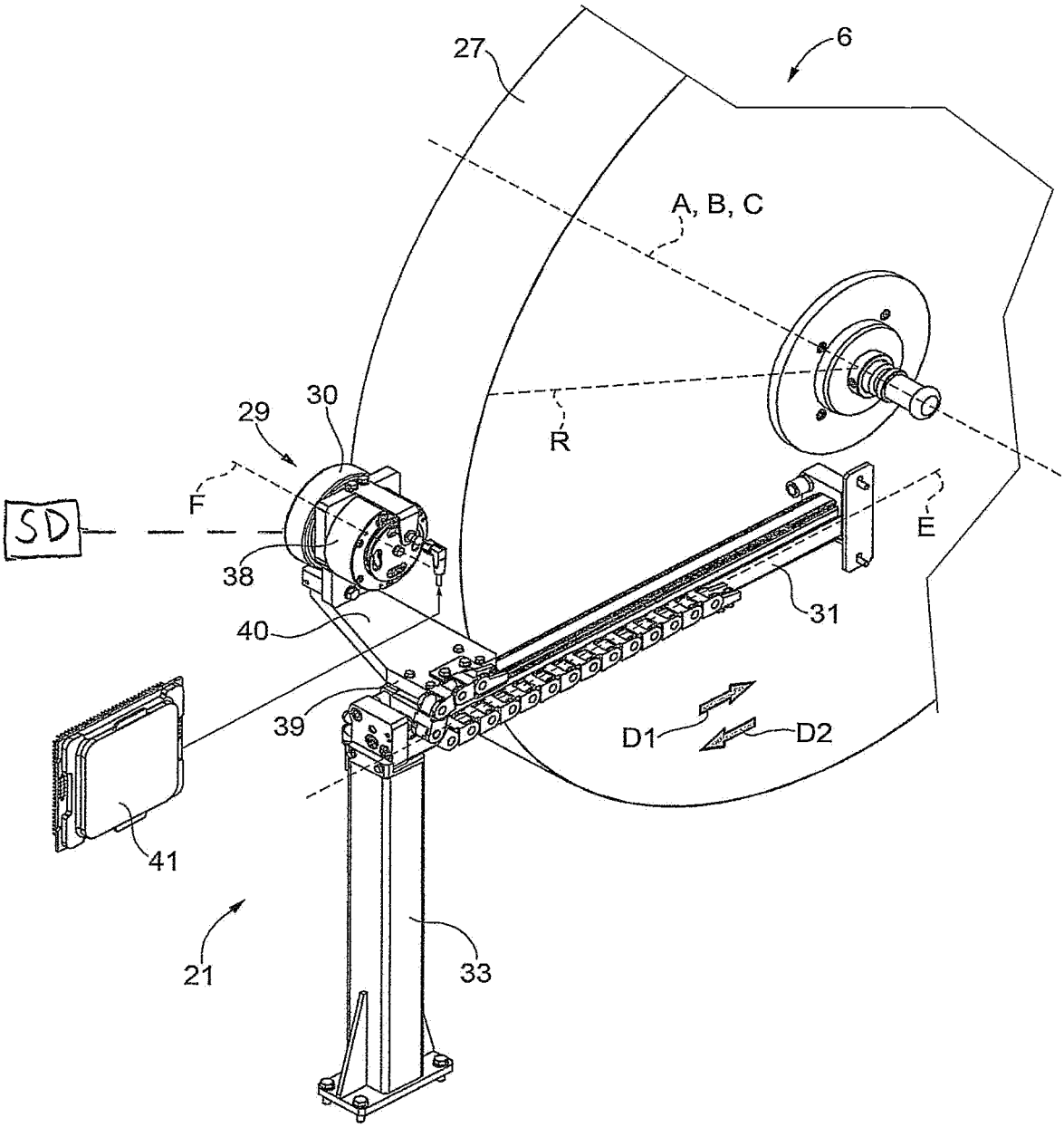
FIG. 3 is an enlarged view of a portion of the detail of FIG. 2, with parts removed for clarity.

With particular reference to FIG. 2, magazine unit 5 comprises at least:

- a support device 20 configured to rotatably carry at least one reel 6 of web 4; and
- a reel brake device 21 configured to decelerate, in particular to stop, rotation of reel 6 around a central axis A of reel 6.

Preferentially, magazine unit 5 also comprises a support structure 22 carrying at least support device 20. Even more preferentially, magazine unit 5, in particular support structure 22, also comprises a cover 23 delimiting an inner space 24 of magazine unit 5 from an outside space. In particular, support device 20 is arranged within inner space 24 so as to host reel 6, in use, within inner space 24.

Preferably, magazine unit 5 also comprises elevation adjustment means, in particular moveable feet elements 25, connected to support structure 22, and being configured to locally control elevation of support structure 22.

In more detail, reel 6 comprises a through-hole adapted to receive a spindle 26, spindle 26 extending along a longitudinal axis B so that spindle 26 carries reel 6. In particular, axis A and axis B being coaxial with spindle 26 being placed through the through-hole.

Preferentially, support device 20 is configured to indirectly carry reel 6 by supporting spindle 26, which in turn carries reel 6.

In particular, reel 6 being indirectly supported by support device 20 is rotatable around central axis A; and, accordingly, spindle 26 carrying reel 6 and being carried by support device 20 is rotatable around longitudinal axis B.

In further detail, reel 6 comprises an outer lateral surface 27, in particular corresponding to the face of web 4, which once the respective packages 2 are formed defines the outer surface of package 2.

Furthermore, reel 6 radially has a with radius R (e.g. reel 6 has a radius R). In use, during the unwinding of web 4 radius R decreases.

In particular, in use, reel 6 rotates around central axis A through a pulling action exercised by conveying means 13 on web 4.

In more detail, support device 20 is configured to retain reel 6, in particular spindle 26 such that central axis A, in particular also longitudinal axis B, is/are parallel, in particular coaxial, to an alignment axis C of support device 20, in particular alignment axis C having a horizontal orientation.

Preferentially, support device 20 comprises at least two housing seats 28 (only one shown) arranged side-by-side and facing one another and being adapted to rotatably carry spindle 26. In particular, housing seats 28 define alignment axis C.

Even more preferentially, each housing seat 28 is configured to receive one respective engagement portion of spindle 26, in particular each engagement portion corresponds to one respective end portion of spindle 26. More specifically, each housing seat 28 is mounted to one respective portion of support structure 22.

With particular reference to FIGS. 1 to 6, reel brake device 21 comprises:

- a brake assembly 29 having an interaction element, in particular a brake wheel 30, adapted to interact with outer lateral surface 27, in particular through brake wheel 30, and being configured to selectively exert a deceleration force, in particular through brake wheel 30, on the, in use, rotating reel 6 for decelerating, in particular for stopping, rotation of reel 6 around central axis A;
- a support rail 31 extending along a longitudinal axis E, in particular being transversal, even more particular perpendicular to alignment axis C, moveably carrying brake assembly 29; and
- an actuator device 32, in particular of the pneumatic type, configured to actuate, in use, movement of brake assembly 29 along support rail 31 (in particular between a first extreme position and a second extreme position) and along a direction D1 parallel to support rail 31 (i.e. parallel to longitudinal axis E) at least towards outer lateral surface 27 so as to bring brake wheel 30 in contact with outer lateral surface 27.

Preferentially, reel brake device 21 also comprises a support bar 33, in particular having a vertical extension, carrying support rail 31.

More specifically, support bar 33 and support rail 31 are transversely, in particular orthogonally, oriented with respect to one another.

In the embodiment shown, support bar 33 is mounted to a horizontal bottom plate 34 (defining a portion of cover 23) of support structure 22.

In an alternative embodiment not shown, support bar 33 could be mounted to the floor of a production plant.

In more detail, brake wheel 30 of brake assembly 29 is adapted to rotate around a rotation axis F, in particular parallel to alignment axis C, upon contact with outer lateral surface 27 and rotation of reel 6 around axis A. In particular, in use, with brake wheel 30 contacting outer lateral surface 27, the rotation of reel 6 is transferred onto brake wheel 30.

Preferentially, brake wheel 30 comprises an outer lateral contact surface for contacting, in particular being of a rubber or rubber-like material.

Preferably, reel brake device 29 also comprises a brake actuator device 38, in particular of the electrical type, coupled to brake wheel 30 and being adapted to selectively exert a force on brake wheel 30 so as to act against rotation of brake wheel 30 around rotation axis F, in particular as actuated by contact of brake wheel 30 with outer lateral surface 27 and rotation of reel 6 around central axis A.

Preferentially, brake assembly 29 also comprises a sensor device SD (schematically shown in FIG. 3), in particular a rotation detection sensor, adapted to determine and/or detect a contact between brake wheel 30 and outer lateral surface 27, in particular by means of detecting rotation of brake wheel 30 around rotation axis F.

In a preferred embodiment, brake assembly 29 also comprises:

- a slide 39 moveably mounted to support rail 31, coupled to actuator device 32 and being adapted to move along support rail 31 by actuation of actuator device 32; and
- a support plate 40 mounted to slide 39 and carrying at least brake wheel 30, preferentially also brake actuator device 38, and protruding sideways from support rail 31.

In particular, in this way, upon movement of slide 39 also brake wheel 30 moves.

Preferentially, magazine unit 5 also comprises a control unit 41 adapted to control reel brake device 21, in particular such that brake wheel 30 is kept, in use, in the proximity of outer lateral surface 27.

Preferentially, control unit 41 is connected to actuation device 32 and is configured to repeatedly activate actuation device 32 according to a predefined time interval, e.g. after every 10 seconds or every 5 seconds, so as to establish, in use and from time to time, a temporary contact between brake wheel 30 and outer lateral surface 27 of reel 6. Even more preferentially, control unit 41 is also configured to repeatedly deactivate actuation device 32, in particular after brake wheel 30 getting, in use, in contact with outer lateral surface 27, in particular so that further movement of brake wheel 30 is interrupted.

In other words, control unit 41 is configured to activate and deactivate actuation device 32 such that brake wheel 30 remains in the proximity of reel 6, in particular outer lateral surface 27, and contacts outer lateral surface 27 only for a limited time. This allows to minimize the contact time of brake wheel 30 with outer lateral surface 27 and to guarantee that the distance between brake wheel 30 and reel 6, in particular outer lateral surface 27, remains within a certain range, such that the reel brake device 21 is able to decelerate, in particular to stop, rotation of reel 6 in case of need with the required reactivity.

It must be noted that the predefined time interval is a function of the advancement speed of web 4 along path P.

Preferably, control unit 41 is also connected to brake actuator device 38 and is configured to activate brake actuator device 38, in particular such that the force exerted by brake actuator device 38 still permits rotation of brake wheel 30 around rotation axis 30 as a result of the interaction with outer lateral surface 27 and rotation of reel 6 around central axis A. In other words, preferentially control unit 41 is configured such to control brake actuator device 38 such that rotation of brake wheel 30 around rotation axis F is decelerated with respect to the rotation of brake wheel 30 around rotation axis F as actuated through the rotation of reel 6.

Preferentially, control unit 41 is also configured to activate contemporaneously actuator device 32 and brake actuator device 38 so as to decelerate, in particular to stop, rotation of reel 6 around central axis A.

Preferentially, control unit 41 is also connected to the sensor device and is configured to receive data signals about a possible rotation of brake wheel 30 around rotation axis F.

Even more preferentially, control unit 41 is configured to activate actuator device 32 also in dependence of the possible rotation of brake wheel 30. In particular, in use, control unit 41 is configured to activate actuator device 32 after the predetermined time interval so as to move brake wheel 30 into direction D1 and towards outer lateral surface 27 and to deactivate actuator device 32 when brake wheel 30 contacts, in use, outer lateral surface 27 (which results, in use, in rotation of brake wheel 30 around rotation axis F, which again is, in use, detected and/or determined by the sensor device).

Preferentially, actuator device 32 is also adapted to actuate movement of brake assembly 29, in particular brake wheel 30, into a direction D2 opposite to direction D2 for positioning brake assembly 29, in particular brake wheel 30, in an initial position, in particular in the proximity of the first extreme position, in which brake wheel 30 is distanced from an unused reel 6 (a new reel 6) retained by support device 20.

In a preferred embodiment, actuator device 32 is a pneumatic cylinder.

In use, packaging machine 1 forms packages 2 filled with the pourable product.

In more detail, conveying means 14 advance web 4 from magazine unit 5 along advancement path P.

In further detail, conveying means 14 advance web 4 from host station 7 to forming station 10 at which web 4 is formed into tube 3. Then conveying means 14 further advance tube 3 along path Q to package forming unit 13. During the advancement of tube 3, filling means 12 fill tube 3 with the pourable product.

Preferentially, during advancement of web 4 along advancement path P web 4 is sterilized at the sterilization station.

Package forming unit 13 forms and transversely seals tube 3 and, preferentially, also transversely cuts tube 3 so as to obtain packages 2.

Advantageously, operation of packaging machine 1 also comprises the steps of:

- rotating reel 6 of web 4 for unwinding web 4 of packaging material, in particular for advancing web 4 of packaging material along advancement path P;
- repeatedly activating actuator device 32 according to predefined time intervals so as to advance at least brake wheel 30, preferentially brake assembly 29, towards and to outer lateral surface 27 and to temporarily establish (from time to time) contact between brake wheel 30 and outer lateral surface 27; and
- repeatedly deactivating actuator device 32 so as to interrupt further advancement of brake wheel 30 after establishing contact between brake wheel 30 and outer lateral surface 27, in particular each step of deactivating is executed at the end of one respective step of activating actuator device 32.

Preferentially, the method for operating packaging machine 1 also comprises the step of decelerating the rotation of reel 6 around central axis A for decelerating, in particular stopping, the rotation of reel 6, preferentially in case of an interruption of operation of packaging machine 1 or in case of an emergency stop of packaging machine 1.

In more detail, during the step of rotating reel 6, reel 6 rotates around central axis A through the exertion of a traction force by conveying means 14 on web 4.

In particular, during rotation of reel 6 around central axis A, radius R decreases with time.

Preferentially, during rotation of reel 6 around central axis A also spindle 26 rotates around longitudinal axis B.

In more detail, repeatedly activating and deactivating actuator device 32 allows to keep brake wheel 30 in the vicinity of outer lateral surface 27 and to minimize the contact time between brake wheel 30 and outer lateral surface 27.

Figure 4:
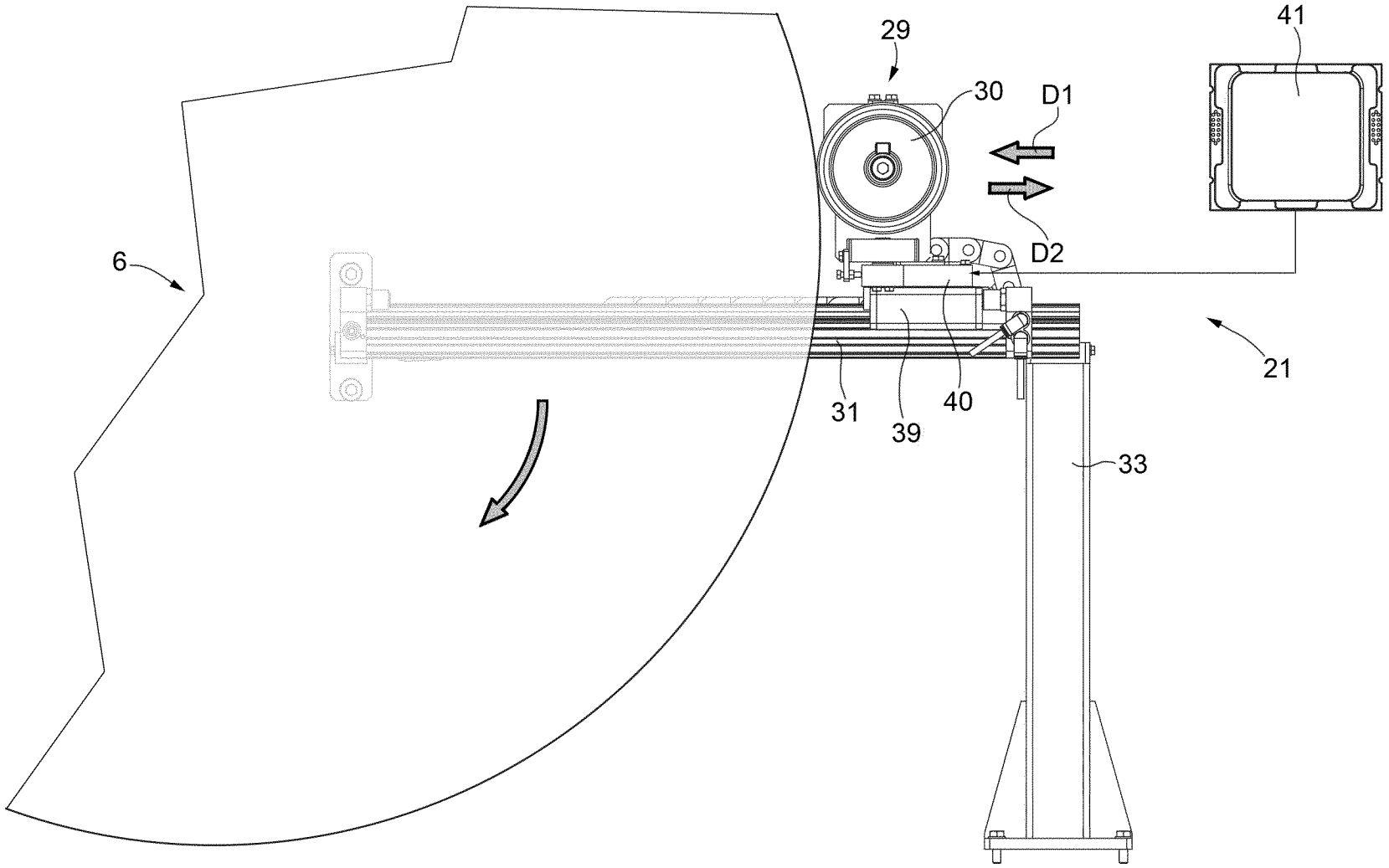
FIGS. 4 to 6 are side views of the portion of FIG. 3 during different operational conditions, with parts removed for clarity.
Figure 5:
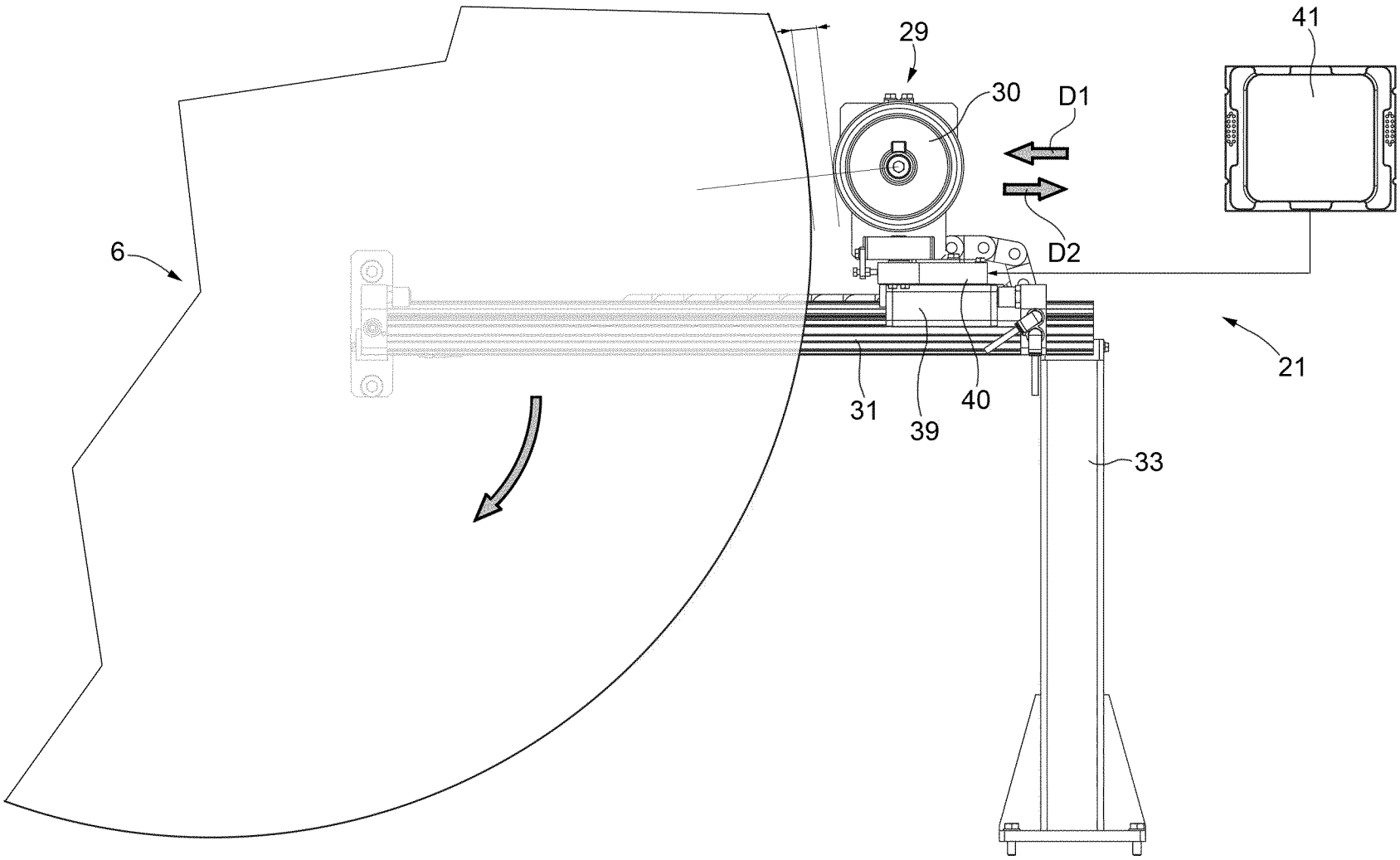
Figure 6:
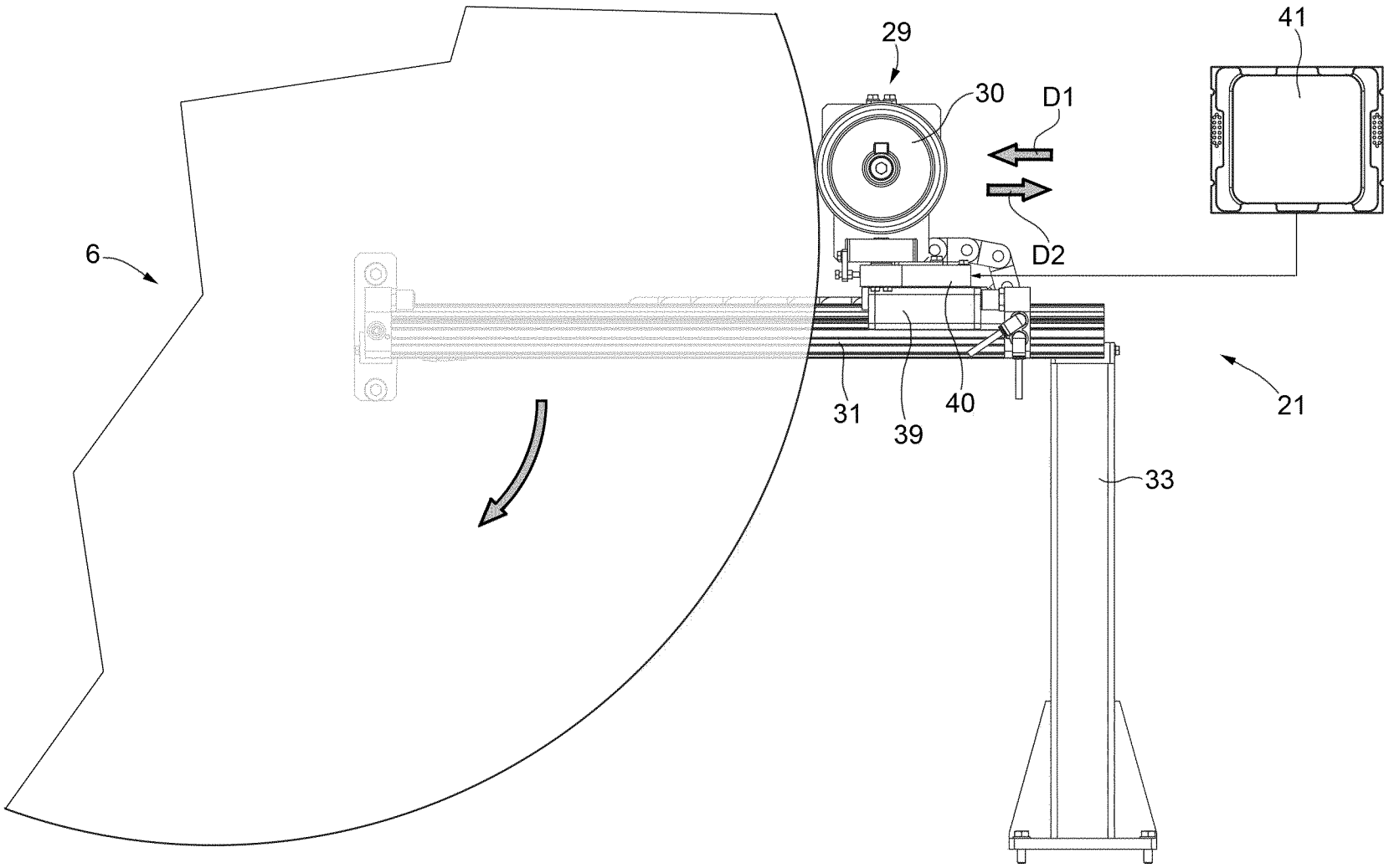

In particular, this is shown in FIGS. 4 to 6. With particular reference to FIG. 4, after bringing brake wheel 30 into contact with outer lateral surface movement of brake wheel 30 into direction D1 is suspended by deactivating, in particular by control unit 41, actuation device 32. As reel 6 further rotates around rotation axis F for further unwinding web 4, the radius R of reel 6 reduces, so creating a gap between outer lateral surface 27 and brake wheel 30 (see FIG. 5). As the actuation device 32 is activated, in particular by control unit 41, after a predetermined time interval, brake wheel 30 gets again into contact with outer lateral surface 27 (see FIG. 6). These steps are repeated during normal operation of packaging machine 1.

More specifically, during the step of repeatedly activating, control unit 41 controls activation of actuation device 32 for controlling movement of at least brake wheel 30, in particular until establishing contact between brake wheel 30 with outer lateral surface 27.

Even more specifically, during the step of repeatedly activating, actuator device 32 advances brake assembly 29 together with brake wheel 30 along direction D1 towards outer lateral surface 27.

In particular, during advancement of brake assembly 29, brake assembly 29, in particular slide 39, advances along support rail 31.

Preferentially, during each step of deactivating actuation device 32, the current position of brake wheel 30 remains unvaried.

Preferentially, operation of packaging machine 1 also comprises the step of detecting and/or determining contact between brake wheel 30 and outer lateral surface and the step of deactivating actuator device 32 is executed if during the step of detecting and/or determining, contact between brake wheel 30 and outer lateral surface 27 is detected and/or determined.

In particular, during the step of detecting and/or determining the sensor device detects and/or determines a rotation of brake wheel 30 around rotation axis F, the latter being indicative of contact between brake wheel 30 and outer lateral surface 27 as the rotation of reel 6 is transferred to brake wheel 30.

In more detail, during the step of decelerating, at least actuator device 32 is activated so as to establish and to keep contact between brake wheel 30 and outer lateral surface 27.

Preferentially, during the step of decelerating, the rotation of reel 6 around central axis A is decelerated, in particular stopped, through simultaneous activation of actuation device 32 and brake actuator device 38 so that brake wheel 30 keeps contact with outer lateral surface 27 of reel 6 and acts against the rotation of brake wheel 30 around rotation axis F, in particular as actuated through the contact between brake wheel 30 and outer lateral surface 27 and rotation of reel 6.

Preferably, the step of decelerating is activated in case advancement of web 4 along advancement path P is to be interrupted, e.g. because of an interruption of the operation of packaging machine 1 or in case of the need of an emergency stop.

The advantages of magazine unit 5 according to the present invention will be clear from the foregoing description.

In particular, by providing reel brake device 21 it is possible to keep braking wheel 30, in use, as close as possible to reel 6, in particular outer lateral surface 27, minimizing the contact time of brake wheel 30 with outer lateral surface 27 (and therewith with web 4) and still maintaining the reactivity of reel brake device 21 in case rotation of reel 6 must be decelerated, in particular interrupted. This again, allows to reduce the risk of a misalignment of web 4 during its advancement.

A further advantage resides in that the braking torque exerted by brake wheel 30 on reel 6 is provided by actuator device 32 and brake actuator device 38. Actuator device 32 presses (forces) brake wheel 30 against outer lateral surface 27 and brake actuator device 38 exerts a force against rotation of brake wheel around rotation axis F (or in other words, brake actuator device 38 acts against the rotation force applied onto brake wheel 30 through rotation of reel 6 around central axis A and contact between brake wheel 30 and outer lateral surface 27).

Clearly, changes may be made to packaging machine 1, in particular magazine unit 5 as described herein without, however, departing from the scope of protection as defined in the accompanying claims.

The invention claimed is:

1. A magazine unit for a packaging machine, the magazine unit comprising:

one support device configured to rotatably carry a reel of a web of packaging material; and a reel brake device configured to at least decelerate a rotation of the reel-(64 around a central axis;

wherein the reel brake device comprises a brake assembly adapted to interact with an outer lateral surface of the reel of the web of packaging material and being configured to selectively exert a deceleration force on the reel of the web of packaging material for at least decelerating the rotation of the reel around the central axis;

wherein the reel brake device further comprises:

a support rail moveably carrying the brake assembly; and an actuator device configured to actuate, in use, movement of the brake assembly along the support rail at least towards the outer lateral surface so as to establish contact of at least an interaction element of the brake assembly with the outer lateral surface of the reel of the web of packaging material.

2. The magazine unit according to claim 1, wherein the support device is configured to carry the reel such that the reel is adapted to rotate around the central axis and the central axis being parallel to an alignment axis of the support device;

wherein the support rail extends along a longitudinal axis being transversal to the alignment axis; and wherein the actuator device is configured to move the brake assembly along a direction parallel to the longitudinal axis.

3. The magazine unit according to claim 1, wherein the brake assembly comprises:

a brake wheel defining the interaction element and being adapted to rotate around a rotation axis upon contact with the outer lateral surface of the reel of web of packaging material; and a brake actuator device coupled to the brake wheel and being adapted to selectively exert a force on the brake wheel so as to act against rotation of the brake wheel around the rotation axis.

4. The magazine unit according to claim 3, wherein the brake assembly comprises a sensor device adapted to detect contact between the brake wheel and the outer lateral surface of the reel of web of packaging material so as to detect a rotation of the brake wheel around the rotation axis.

5. The magazine unit according to claim 1, wherein the actuator device is a pneumatic cylinder.

6. The magazine unit according to claim 1, further comprising a control unit configured to repeatedly activate the actuation device according to predefined time intervals so as to establish, in use, a temporary contact between the interaction element and the outer lateral surface of the reel of web of packaging material.

7. A packaging machine for producing sealed packages of a pourable product comprising:

an isolation chamber separating an inner environment from an outer environment;

a tube forming device at least partially arranged within the isolation chamber at a forming station and being adapted to form a tube from a web of packaging material;

a sealing device at least partially arranged within the isolation chamber and being adapted to longitudinally seal the tube formed by the tube forming device;

filling means for filling the tube with the pourable product;

a package forming unit adapted to form and to transversally seal the tube for forming the packages;

conveying means for advancing the web of packaging material along a web advancement path from a host station to the forming station and for advancing the tube along a tube advancement path to the package forming unit;

a magazine unit according to claim 1 and being adapted to host a reel of a web of packaging material at the host station.

8. A method for operating a packaging machine for producing packages filled with a pourable product, the packaging machine having a magazine unit comprising:

a support device configured to rotatably carry a reel of a web of packaging material; and a reel brake device configured to decelerate a rotation of the reel around a central axis;

wherein the reel brake device comprises a brake assembly adapted to interact with an outer lateral surface of the reel of the web of packaging material and being configured to selectively exert a deceleration force on the reel of web of packaging material for at least decelerating the rotation of the reel around the central axis;

wherein the brake assembly comprises an interaction element configured to at least temporarily engage with the outer lateral surface of the reel and an actuator device adapted to advance at least the interaction element towards the outer lateral surface of the reel;

the method comprises at least the steps of:

rotating the reel of the web of packaging material for unwinding the web (4) of packaging material;

repeatedly activating the actuator device according to predefined time intervals so as to move the interaction element towards and to the outer lateral surface and to temporarily establish contact between the interaction element and the outer lateral surface; and deactivating actuator device so as to interrupt further advancement of brake wheel after establishing contact between brake wheel and outer lateral surface.

9. The method according to claim 8, wherein during the repeatedly activating, the actuator device advances the brake assembly together with the interaction element along a direction towards the outer lateral surface of the reel.

10. The method according to claim 8, and further comprising detecting and/or determining contact between the interaction element and the outer lateral surface, the step of deactivating the actuator device being executed if contact between the interaction element and the outer lateral surface is detected and/or determined during the step of detecting and/or determining.

11. The method according to claim 8, wherein the interaction element is a brake wheel being adapted to rotate around a rotation axis;

wherein the brake wheel rotates around the rotation axis upon contact with the outer lateral surface of the reel;

wherein the reel brake device further comprises a brake actuator device configured to exert a force on the brake wheel so as to act against rotation of the brake wheel around the rotation axis for decelerating the rotation of the reel around the central axis;

the method further comprising decelerating the rotation of the reel around the central axis through simultaneous activation of the actuation device and the brake actuator device so that the brake wheel establishes and keeps contact between the outer lateral surface of the reel and a force acts against the rotation of the brake wheel around the rotation axis.

* * * * *